United States Patent [19]

Warren et al.

[11] Patent Number: 4,938,293

[45] Date of Patent: Jul. 3, 1990

[54] LINEAR FIRE EXTINGUISHER

[75] Inventors: Donald E. Warren, Berkeley; Maurice E. Tyler, Orinda, both of Calif.

[73] Assignee: Systron Donner Corp., Concord, Calif.

[21] Appl. No.: 392,218

[22] Filed: Aug. 7, 1989

Related U.S. Application Data

[63] Continuation-in-part of Ser. No. 43,928, Apr. 29, 1987, Pat. No. 4,854,389.

[51] Int. Cl.[5] ..... A62C 35/08; A62C 35/12

[52] U.S. Cl. ..... 169/28; 169/58; 169/61; 169/62

[58] Field of Search ..... 169/28, 26, 53, 58, 169/62, 66, 35, 60, 61; 244/129.2, 135 R

[56] References Cited

U.S. PATENT DOCUMENTS

| | | | |
|---|---|---|---|
| H,141 | 10/1986 | Finnerty et al. | 169/28 |
| 576,026 | 1/1897 | Bunker et al. | 169/28 |
| 2,815,819 | 12/1957 | Marshall | 169/62 X |
| 3,482,637 | 12/1969 | Mitchell et al. | 169/28 X |
| 3,833,063 | 9/1974 | Williams | 169/28 |
| 3,874,458 | 1/1975 | Williams | 169/28 X |
| 3,884,307 | 5/1975 | Williams | 169/28 X |
| 3,986,560 | 10/1976 | Heath et al. | 169/28 X |
| 4,296,817 | 10/1981 | Monte | 169/61 X |
| 4,702,322 | 10/1987 | Richardson | 169/28 |
| 4,854,389 | 8/1989 | Warren et al. | 169/28 |

FOREIGN PATENT DOCUMENTS

| | | | |
|---|---|---|---|
| 2305763 | 8/1973 | Fed. Rep. of Germany | 169/62 |
| 467899 | 12/1951 | Italy | 169/26 |
| 262697 | 12/1926 | United Kingdom | 169/62 |

*Primary Examiner*—Joseph F. Peters, Jr.
*Assistant Examiner*—James M. Kannofsky
*Attorney, Agent, or Firm*—Flehr, Hohbach, Test, Albritton & Herbert

[57] ABSTRACT

A linear fire extinguisher includes a high strength elongated tube containing a pressurized fire extinguishant such as HALON 1301. A pair of opposed shaped charges is placed along the exterior or interior of the tube and when actuated provides cutting lines which cause a directed distribution of the fire extinguishant along the lines in an opposed manner to provide a net reaction force of substantially zero on the tube. A helical geometry is also provided which provides a substantial reduction in reactive forces.

4 Claims, 4 Drawing Sheets

LINEAR FIRE EXTINGUISHER

This is a continuation-in-part application of application Ser. No. 043,928 filed April 29, 1987, entitled "Linear Fire Extinguisher" and now patent 4,854,389. The present invention is directed to a linear fire extinguisher and more specifically to a fire extinguisher especially useful for the dry bays and fuel tanks in airplane wings and fuselages.

BACKGROUND OF THE INVENTION

High pressure bottles or canister type powder suppressors have been used in the wing areas of aircraft. These are explosively actuated to provide a quick opening valve, such as illustrated in Tyler patent 4,003,395, assigned to the present assignee. In addition to the relatively high weight of the system it has a distribution of the point source type. A linear type distribution of flame-quenching agent has been proposed in Mitchell patent 3,482,637, using a detonator cord along a tube containing the fire extinguishing agent. Here the application is in coal mines using tubing such as acrylic plastic materials. It has a distribution time of the flame quenching agent of about 40 milliseconds. Both the material and distribution time are unsuitable for aircraft use. Another similar fire extinguisher of either molded plastic or very light weight metal which is easily rupturable is shown in Finnerty invention registration H141, published Oct. 7, 1986. The Finnerty device is useful for ammunition fires or vehicular fires, but because of the lack of pressure and the material used it is unsuitable for aircraft use.

OBJECT AND SUMMARY OF INVENTION

It is the general object of the present invention to provide an improved linear fire extinguisher.

In accordance with the above invention there is provided a linear fire extinguisher comprising a closed elongated high strength metal tubular container having an axis along which it is elongated and having its interior volume substantially filled with a fire extinguishant. The container is pressurized so that when it is cut the extinguishant is substantially distributed within a time period of less than 10 milliseconds. Explosive means are provided for cutting the container along a single line or pair of lines substantially parallel to the axis and extending substantially the length of the container as measured along the axis to provide a net reaction force which is relatively low.

DESCRIPTION OF PREFERRED EMBODIMENTS

Figure 1:
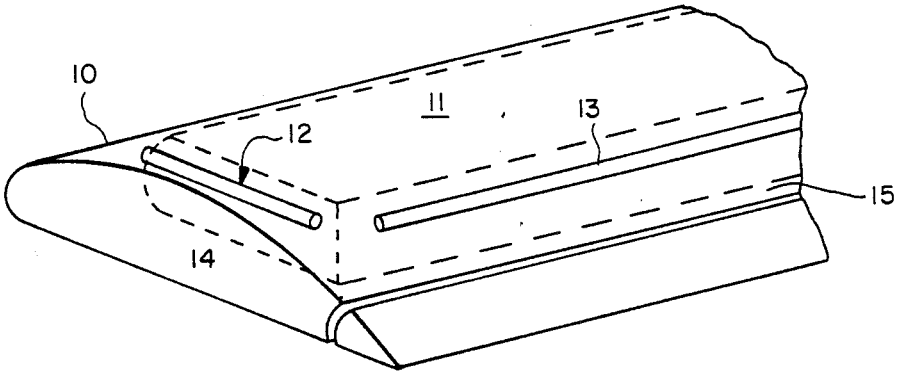
FIG. 1 is a perspective view showing the linear fire extinguisher installed in the dry bay of an airplane wing.

FIG. 1 illustrates a wing section 10 with a fuel cell 11 shown in dashed outline which has attached to it linear fire extinguishers 12 and 13 which incorporate the present invention. The unoccupied portions of the wing shown at 14 and 15 are known as dry bays.

The invention, of course, has other applications, as for example, in an engine compartment, or, in fact, in non-aircraft applications, where a linear uniform distribution of a fire extinguishing agent is necessary along a fairly long axis. Also, although illustrated in a dry bay, the extinguisher may be placed inside a fuel tank.

Figure 2:
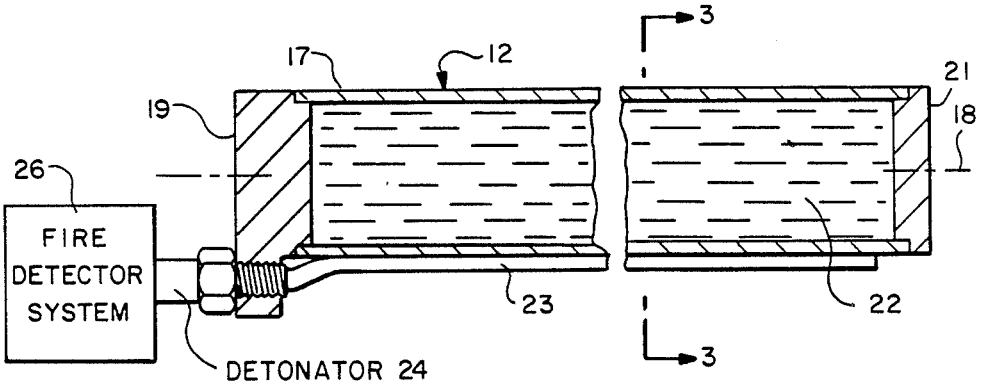
FIG. 2 is a cross-sectional view of the fire extinguisher of the present invention, showing it connected to a fire detector system, along with a detonator.

Linear fire extinguisher 12 is illustrated in greater detail in FIG. 2 and is composed of a tubular container 17 having an axis 18 and which is sealed at its ends by plugs 19 and 21 so that pressures of several thousand psi may be applied. It is substantially filled with a fire extinguishant 22. Extending along the outside of the tube 17 along a line substantially parallel to axis 18 is an explosive linear shaped charge 23 which for example is available under the trademark "Jetcord." It is filled with an explosive material such as RDX (cyclotrimethylene trinitramine). A detonator unit 24 is provided which is attached at end 19 and the detonator is actuated by a fire-detection system 26 when installed for use. Alternatively, detonator 24 may itself be thermally sensitive so that when shipping, excessive temperatures will explode the charge 23 so that excessive pressure buildup does not occur within cylinder or tube 17. Also, there could be a detonator 24 at each end of the charge 23, wherein one could be initiated electrically and one could be activated by excess temperature.

Figure 3:
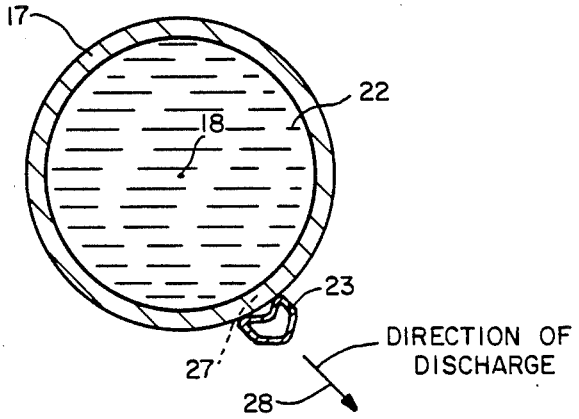
FIG. 3 is a cross-sectional view taken along the line 3—3 of FIG. 2.

FIG. 3 illustrates the cross-section of the tubular container 17 and shows the shaped charge 23 as it would be affixed to the contained, for example, by a simple adhesive. Alternatively, shaped charge 23 can be provided with a standoff of, for example, a few millimeters from the container by known techniques to provide a gap which is more effective when the shaped charge is used for cutting large diameter tubes. Also, in addition, a cover can be placed over the shaped charge 23 to enhance its cutting capability.

Figure 4:
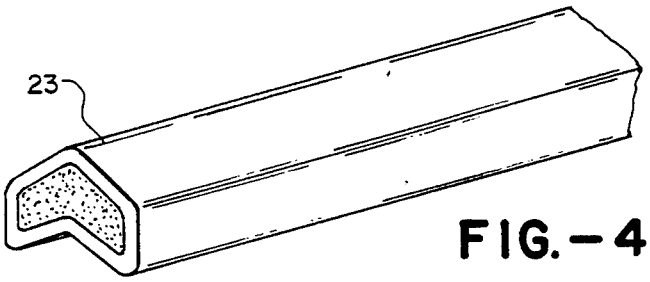
FIG. 4. is a perspective view of a linear shaped charge used in the present invention.
Figure 5:
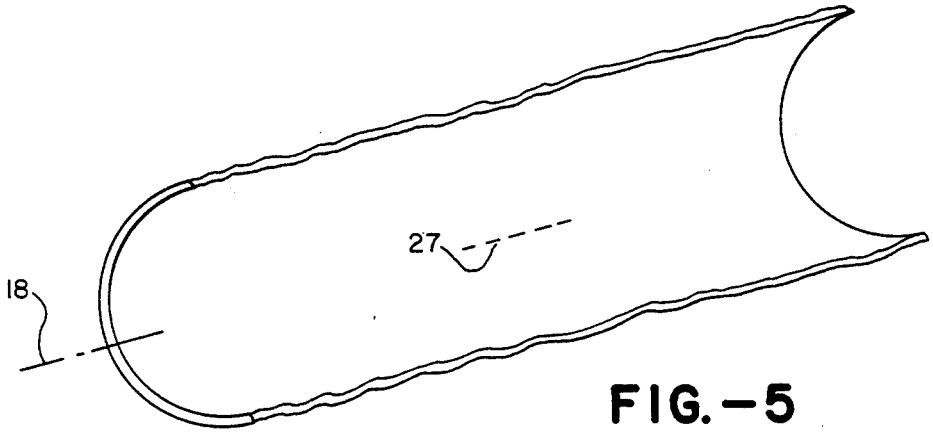
FIG. 5 is a perspective view of the tubular fire extinguisher after it has been cut by the linear shaped charge.

FIG. 4 illustrates the linear shaped charge in perspective and FIG. 5, the line of cutting 27 which line is substantially parallel to the axis 18 of the tube. The type of deformation the shaped charge causes is shown with the tubular container opened.

Figure 6:
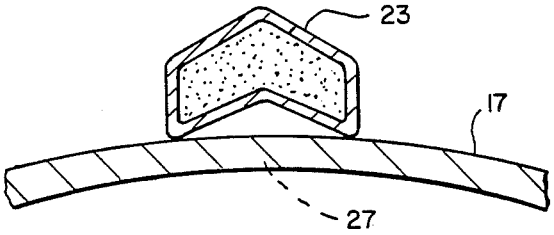
FIG. 6 is a greatly enlarged view of a portion of FIG. 3 showing the mounting of the linear shaped charge on the tubular fire extinguisher.

FIG. 6 shows the shaped charge 23 enlarged as it would be typically affixed to tubing on 17 by a suitable adhesive. From the shape of the charge is readily apparent that the V-shape or chevron-type configuration will provide an accurate linear cut along the line 27.

Figure 7:
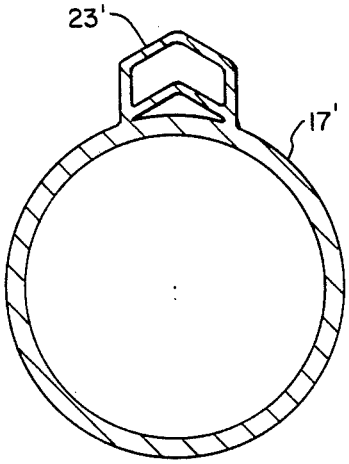
FIG. 7 is a cross-sectional view of an alternative embodiment of the invention corresponding to FIG. 3.

Finally, FIG. 7 is an alternative embodiment showing a tube 17′ where the shaped charge 23′ is an integral part of the tube. In other words, it is manufactured in a single tube drawing.

Referring to FIG. 3, the fire extinguishant 22 is pressurized sufficiently so that upon cutting of the tube 17 a direction or vector of discharge will occur on a line drawn from the axis 18 to the line 27 and indicated as 28. Thus, this provides a very controlled direction of radial distribution with a fan-like spreading; i.e., the angle may be typically 90° to as much as 180°.

In general, the pressure initially placed in the tube can vary from as little as 200 psi to 2,000 psi. In a preferred embodiment where, for example, the fire extinguishing agent is HALON 1301 which is known more commonly as monobromotrifluoromethane, the tube will be pressured to approximately 600 psi with nitrogen gas, and most of the nitrogen will be dissolved in the liquid HALON. The reason for the pressurization of the fire extinguishant in the tube is to improve distribution and most importantly improve the speed of distribution. For extinguishing aircraft fires in the wing section it is required that extinguishers operate in less than 15 milliseconds. In the present invention almost full distribution of the fire extinguishant occurs in much less than 10 milliseconds; for example, less than 5 milliseconds. Thus, time of operation is of critical importance in extinguishing aircraft fires. Another reason for pressurization, especially in the case of the liquid HALON material is that at lower temperatures, for example, at minus 65° Fahrenheit (in other words, below freezing) the pressure is considerably reduced from the room temperature at which the tube was filled.

Other suitable fire extinguishant materials, in addition, are other varieties of HALON (halogenated hydrocarbon) such as 1211, and 2402 and mixtures thereof. Dry powders and dry chemicals, such as aluminum oxide and the more common potassium and sodium salts, may also be used.

In order to minimize gravity effects, especially with liquids such as HALON, the tube should be substantially totally filled to, for example, 95 to 100%. Such filling also promotes the distribution. Also, in the case of powder, a super pressurization causes the powder-like material to perform similarly to liquids such as HALON.

Because of the high pressures utilized, the tube 17 must of course be of high strength but yet light weight for the aircraft environment. This is provided by the use of high strength stainless steel hydraulic-type tubing. One type of tubing utilized is type 21-6-9 per the AMS 5561 standards. A typical dimension of such tubing would be a wall thickness of 0.016 inches with a length of approximately 4 feet and an overall diameter of 0.5 inches. The stainless steel grade referred to as 21-6-9 refers to the components of chromium, nickel and manganese. With the foregoing type of dimensions and a pressure of 600 psi, a HALON-filled fire extinguisher when cut fills a dry bay as illustrated in FIG. 1 in just under 5 milliseconds. With regard to the tube design, a wall thickness of 0.016 inches for smaller diameters of 0.437 to 0.500 is suitable and for larger diameters of 0.625 to 0.750 inches a wall thickness of 0.020 inches is suitable. With tubes of these designs and of the hydraulic type, the proof pressure will exceed 5,000 psi.

Such high pressure capability is necessary since the almost total filling of the tube with, for example, HALON, under elevated temperature conditions the curve of temperature with respect to pressure is very steep. That is, at elevated temperatures the pressure of a totally filled tube will be several thousand psi; for example, approaching 5,000 psi. Thus, to survive expected ambient conditions the tubing must be very high strength. But, however, with the use of the stainless type hydraulic tubing of the kind mentioned, a relatively light weight is still achieved so that it is still useful in aircraft applications.

With the use of the Jetcord type shaped charge and as applied to the type of hydraulic tubing specified, the cutting line 27, as illustrated in FIG. 5, occurs in a few hundred microseconds. In conjunction with the pressurization of the extinguishing material a very uniform distribution takes place immediately as well as entirely along the axis 18 for the length of the tube.

Figure 8:
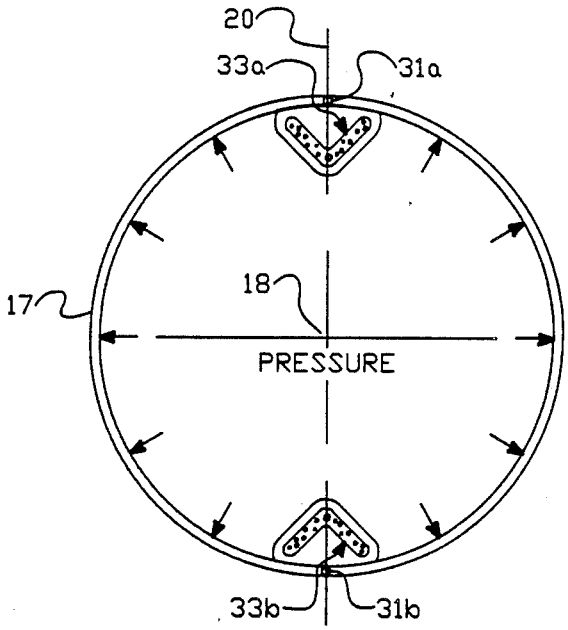
FIG. 8 is a cross-sectional view of an alternative embodiment.

In addition to providing the shaped charge 23 external to the container 17, as illustrated in the previous figures, FIG. 8 shows that the charge 23 may be alternatively placed internal to the chamber. Although FIG. 8 shows two shaped charges **33*a*, 33*b*, a single charge may be utilized in accordance with the invention as thus far described. This has the advantage of providing protection for the relatively fragile shaped charge within the relatively thick and durable walls of container 17**.

However, in accordance with another embodiment of the invention, as illustrated in FIG. 8, a pair of shaped charges **33*a* and 33*b*, which are opposed and in fact lie on the diameter 20 of tube 17 (which of course passes through its center 18) may be provided. Thus, these shaped charges provide a cutting action along the lines 31*a* and 31*b*, as illustrated in FIG. 9**.

As further illustrated, the reaction force, F1, of the escaping HALON is equal and opposite to the reaction force, F2, of the HALON escaping on the opposite side and thus the net reaction force is substantially reduced or close to zero in this case. Reduction of reaction forces may be important in some applications where the wing structure of an aircraft is fragile, since otherwise the fire extinguisher may act like a jet-propelled rocket, depending on pressures, sizes and specific application.

Figure 9:
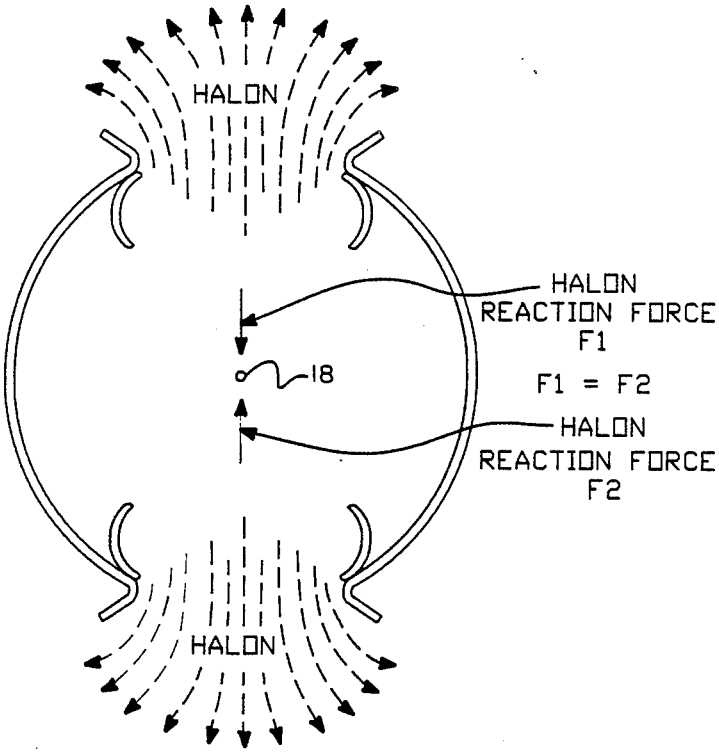
FIG. 9 shows FIG. 8 after explosive cutting has occurred.

Thus, in the embodiment of FIG. 9 (shown as it is exploding), a pair of fan-like spreadings along the length of the container are provided. And this is provided by the pair of opposed linear shaped charges **33*a* and 33*b* which lies in the common plane which also includes the axis 18 of tube 17**.

The same result of course of providing a minimal reaction force would be accomplished by installing the linear shaped charges external to the tube, as illustrated in FIG. 3 but, of course, with the placement of a second opposed charge diametrically opposite first.

Figure 10A:
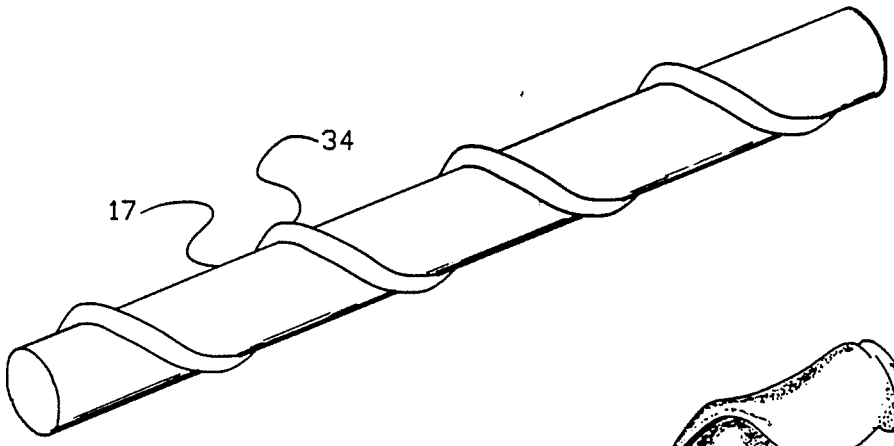
FIGS. 10A and 10B are perspective views of an alternative embodiment.
Figure 10B:
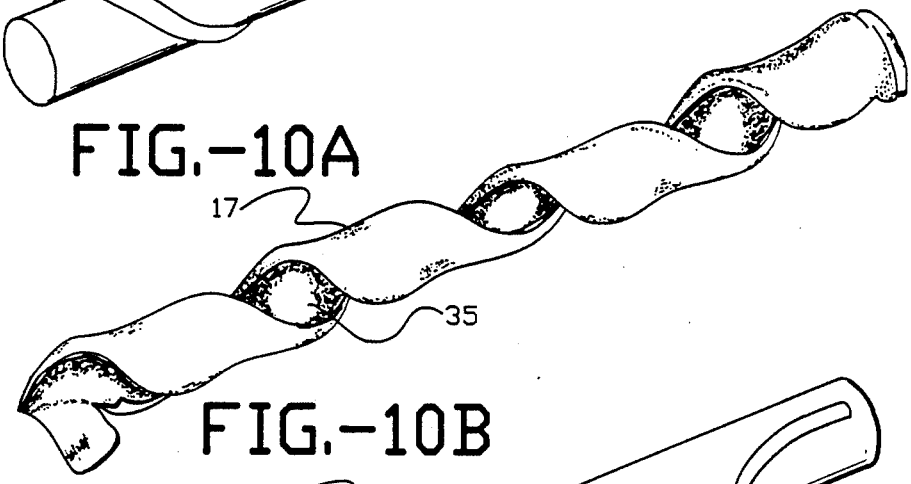

A further helical installation is shown by FIGS. 1OA and 10B where in FIG. 10A wrapped around the tube 17 in a helical-like pattern is a linear shaped charge 34. FIG. 10B shows the tube after it is exploded or has been cut with the helical pattern 35; as is apparent, the net reactive force when summed along the length of the tube is relatively low or approaching zero. In any case, it's much less than the reactive force which occurs in the first embodiment, as shown in FIG. 3.

Figure 11A:
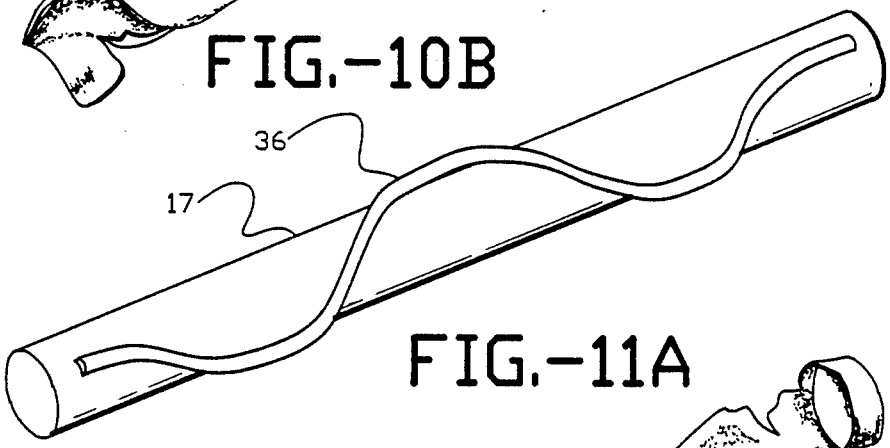
FIGS. 11A and 11B are perspective views of an alternative embodiment.
Figure 11B:
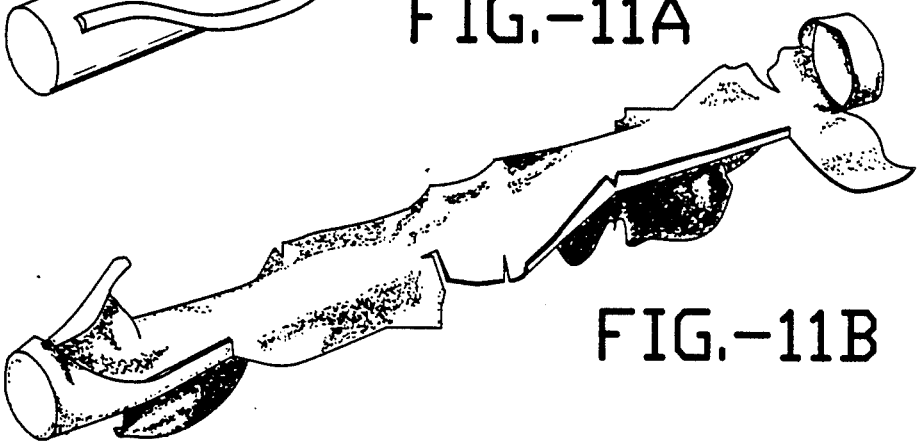

Lastly, as FIGS. 11A and 11B show, a helical-like or curved configuration 36 on tube 17. In the exploded version in FIG. 11B, although the net force may have some value (because of the fact that the linear shaped charge does not cover the opposite side of the tube fully) it is still significantly reduced. And of course in both FIGS. 10 and 11 the charge may be placed if desired on the inside of the tube.

Thus, an improved linear fire extinguisher, especially suitable for aircraft application, has been provided.

We claim:

1. A linear fire extinguisher for aircraft and other similar applications where a linear uniform distribution of a fire extinguishing agent is necessary along a long linear distance comprising:

a closed, elongated high strength metal tubular container having an axis along which it is elongated and having its interior volume substantially totally filled with a fire extinguishant and pressurized, means for explosively cutting said container along a pair of substantially opposed lines extending the length of said container as measured along said axis, said opposition providing a net reaction force of substantially zero on said tube when cut, said cutting means including a pair of linear shaped explosive charges in substantial respective contact with said container along substantially all of said pair of lines to thereby provide a uniform radial distribution of extinguishant with a pair of fan-like spreadings along the length of said container within a time period of less than ten (10) milliseconds of explosively cutting said container.

2. A linear fire extinguisher as in claim 1 where said shaped charges are internal to said container.

3. A linear fire extinguisher as in claim 1 where said pair of linear shaped charges lies in a common plane which also includes said axis of said container.

4. A linear fire extinguisher for aircraft and other similar applications where a linear uniform distribution of a fire extinguishing agent is necessary along a long linear distance comprising:

a closed, elongated high strength metal tubular container having an axis along which it is elongated and having its interior volume substantially totally filled with a fire extinguishant and pressurized, means for explosively cutting said container along a line extending the length of said container as measured along said axis, and arranged in a helical-like pattern to provide a substantially reduced net reaction force on said tube when cut compared to the use of a single line parallel to said axis, said cutting means including a linear shaped explosive charge in substantial respective contact with said container along substantially all of said line to thereby provide a uniform radial distribution of extinguishant with a fan-like spreading along the length of said container within a time period of less than ten (10) milliseconds of explosively cutting said container.

* * * * *